US006910833B2

(12) United States Patent
Price et al.

(10) Patent No.: US 6,910,833 B2
(45) Date of Patent: Jun. 28, 2005

(54) BLOCK WITH MULTIFACETED BOTTOM SURFACE

(75) Inventors: Gerald P. Price, Rochester, MN (US); Raymond R. Price, Rochester, MN (US)

(73) Assignee: Rockwood Retaining Walls Inc, Rochester, MN (US)

( * ) Notice: Subject to any disclaimer, the term of this patent is extended or adjusted under 35 U.S.C. 154(b) by 0 days.

(21) Appl. No.: 10/438,385

(22) Filed: May 15, 2003

(65) Prior Publication Data

US 2003/0194279 A1 Oct. 16, 2003

Related U.S. Application Data

(63) Continuation of application No. 09/864,357, filed on May 23, 2001, now Pat. No. 6,592,301.

(51) Int. Cl.[7] ..... E04C 2/04

(52) U.S. Cl. ..... 405/284; 52/604; 52/605; 52/608

(58) Field of Search ..... 52/604, 605, 606, 52/608; 405/284; D25/113

(56) References Cited

U.S. PATENT DOCUMENTS 572,762 A * 12/1896 Landers ..... 210/498
D31,267 S * 7/1899 Bates ..... D9/305
4,936,712 A * 6/1990 Glickman ..... 405/284
D311,444 S * 10/1990 Forsberg ..... D25/113
D313,280 S * 12/1990 Rodenburgh et al. ..... D25/113
5,072,566 A 12/1991 Zeidman
5,281,048 A * 1/1994 Hagenah ..... 404/44
5,622,456 A * 4/1997 Risi et al. ..... 405/284
5,827,015 A * 10/1998 Woolford et al. ..... 405/286
5,943,827 A * 8/1999 Okerlund ..... 52/28
6,178,715 B1 * 1/2001 Pacitto et al. ..... 52/604
6,250,850 B1 * 6/2001 Price et al. ..... 405/284
6,592,301 B2 * 7/2003 Price et al. ..... 405/284

* cited by examiner

*Primary Examiner*—Gary S. Hartmann
(74) *Attorney, Agent, or Firm*—Moore, Hansen & Sumner

(57) ABSTRACT

A block for use in constructing a retaining wall. The block has a bottom with a non-planar portion that forms a gap between the block and the top surface of a lower course of similar blocks when the block is placed thereon. This gap allows the block to rest on the lower course of blocks in a stable, level manner by providing a space that can accommodate small amounts of intrusive material such as rubble, dirt, or miscellaneous debris which would otherwise interfere with the stacking of the blocks. The block's bottom may also include a plurality of grooves that provide additional clearance in the gap for larger bits of intrusive material such as pebbles or small stones. Preferably, the grooves have angled walls which act to funnel the larger bits of intrusive material into an area of adequate clearance when the block is being placed on a lower course of similar blocks.

20 Claims, 3 Drawing Sheets

BLOCK WITH MULTIFACETED BOTTOM SURFACE

CROSS REFERENCE TO RELATED APPLICATIONS

This application is a Continuation of application Ser. No. 09/864,357 filed May 23, 2001 now Pat. No. 6,592,301, which is a Continuation of Application Ser. No. 09/377,094, filed Aug. 19, 1999, now Pat. No. 6,250,850.

BACKGROUND OF THE INVENTION

This invention relates generally to the construction of retaining walls used in landscaping applications. Such walls are used to provide lateral support between differing ground levels where the change in one elevation to the other occurs over a relatively short distance, thereby reducing the possibility of erosion and landslides. Retaining walls can be both functional and decorative and range from small gardening applications to large-scale construction. They are constructed of a variety of materials and shapes. Some have been constructed of wood timbers, others of rock in a natural form (such as limestone). Still others have been constructed of manufactured aggregate or concrete blocks. The present invention relates to a manufactured block.

Constructing a fit and true retaining wall can be an arduous endeavor. In addition to laying a level first course on ground that is usually located at the foot or in the side of a steep embankment, the builder must ensure that each subsequent course is level. An error made in a lower course is usually exaggerated as higher courses are stacked above it. As a wall made of blocks necessarily develops somewhat of a grid-like appearance, interruptions or undulations in the lines of the wall become readily apparent to the human eye.

One particular problem the prior art has failed to overcome is developing a retaining wall block shaped to avoid these undulations and interruptions which are caused by blocks being stacked on dirt or debris found on the upper surface of the lower course of blocks. Dirt presents itself as a result of the fill material used to fill the gap between the rear of the wall and the earth it is being built to retain. This fill material usually consists of small, coarse rocks. They serve as a barrier between the earth and the wall and prevent wet earth from seeping through the bricks of the wall during inclement weather. Present wall building methods include laying a course of blocks, filling the space behind the course with fill material, packing the fill material, and carefully sweeping the dirt off each completed course prior to the addition of the next course. This final, sweeping step is time consuming but necessary to ensure the next course of blocks lies flat on the lower course.

Some larger blocks incorporate continuous cavities that extend from their bottom surface to their top surfaces. These cavities are intended to reduce the amount of material required to form the block, thereby reducing its cost and weight, and also allow an area to be filled with fill material once a course is finished. At first blush it would appear that, because the presence of cavities reduces the surface area of the top and bottom of the block, they would also serve to decrease the area for interference by small stones and debris between courses. However, because the cavities are filled with fill material, the fill material spills over the upper surfaces and exacerbates, rather than alleviates, the problem. Furthermore, smaller blocks cannot incorporate cavity portions without jeopardizing their structural integrity.

The inability of smaller blocks to accommodate cavity portions creates further problems. Making a solid block out of concrete results in a dense rock that is heavy for its relatively small size. Working with these rocks can become cumbersome. The absence of cavities or interruption in the sidewalls makes these blocks difficult to lift. They have few areas that lend themselves to easy gripping and lifting. This becomes an important consideration in light of the number of blocks that must be lifted and set in place during the construction of even a relatively small retaining wall.

It would be desirable to develop a retaining wall block shaped to accept a certain amount of dirt and debris from course to course without adversely affecting the overall structure and aesthetics of the resulting wall. It would also be desirable to devise a small retaining wall block which is has a reduced unit weight due to the absence of block material in an area that will not adversely affect the strength of the block, nor its appearance. Finally, it would be desirable to provide a small retaining wall block that is relatively easy to grasp and pick up off a stack of similar blocks.

SUMMARY OF THE INVENTION

The present invention advantageously provides a block for use in building a retaining wall that produces a level course of blocks, despite the presence of a small amount of debris on the lower course of blocks.

The present invention is also advantageous in that it provides a relatively small block with material removed from strategic locations to provide a block that is lighter than it would have been had it been solid, yet the removal of material has not adversely affected the strength of the block, nor the appearance of the resulting wall.

The present invention advantageously provides a block that has areas for a person building a retaining wall to grasp the block when lifting the block off a stack of such blocks and placing the block on a lower course of blocks in the wall being constructed.

The instant invention relates to a retaining wall block so shaped that when placed on top of a lower course of similar blocks, it lies flat despite the inevitable presence of dirt, small stones, and other debris. This feature alleviates the time-consuming step of meticulously cleaning the top of each course of blocks before the next course may be laid on top of it.

The block generally comprises a continuous top surface, side surfaces extending from the top surface, front and back surfaces extending from the top surface and spanning laterally between the side surfaces and a bottom surface integral with the front, back and side surfaces.

In order to achieve the tolerance of small stones and debris between courses, a portion of the bottom face of the block of the present invention is non-planar, more specifically, concave. This concave surface significantly reduces the area for block-to-block contact between successive courses. Preferably, this non-planar portion covers more than one-half of the area of the bottom surface of the block. It also functions to provide an area of clearance or a gap between the stones where debris can migrate without causing interference or instability between courses. The concave portion is preferably shaped to form a portion of a cylinder and extends from one side surface to the other. Alternatively, the concave portion could be shaped to form a portion of a sphere or any other shape.

In addition to the concave portion of the bottom surface, the present invention further comprises a plurality of grooves formed in the bottom surface and preferably extending transversely of the bottom surface between the front and back surfaces. The grooves preferably are angled inwardly to form an inverted "V" shape when the block is given its intended orientation. The grooves allow spaces of increased clearance for larger stones. The grooves preferably comprise two opposed surfaces of a predetermined width extending the length of the groove. The two surfaces are angled to form a "V" shape and meet to form an angle α. The angled walls of the grooves not only reduce the weight of the block, but also act to funnel larger stones into the grooves, thereby positioning them into an area of maximum clearance. Alternatively, the first and second surfaces may be joined by a third, curved or flat, surface juxtaposed between the first and second surfaces. Such a third surface would give the groove an inverted "U" shape. The grooves are cut into the block and have a set depth that follows the irregular contour of the non-planar bottom surface.

Preferably, the bottom surface further comprises one or more downward projections proximate the rear surface and having an abutting surface which contacts the rear surface of a lower course of blocks when the block is stacked thereon. It is envisioned that the abutting surface is either parallel to the rear surface of the block, or forms an angle β with the rear surface. These projections create an automatic and uniform setback among successive courses of blocks so that the resulting retaining wall is angled rearwardly. This adds resistive strength to the wall against the natural forces exerted on the wall by the earth the wall is retaining.

DETAILED DESCRIPTION

Figure 1:
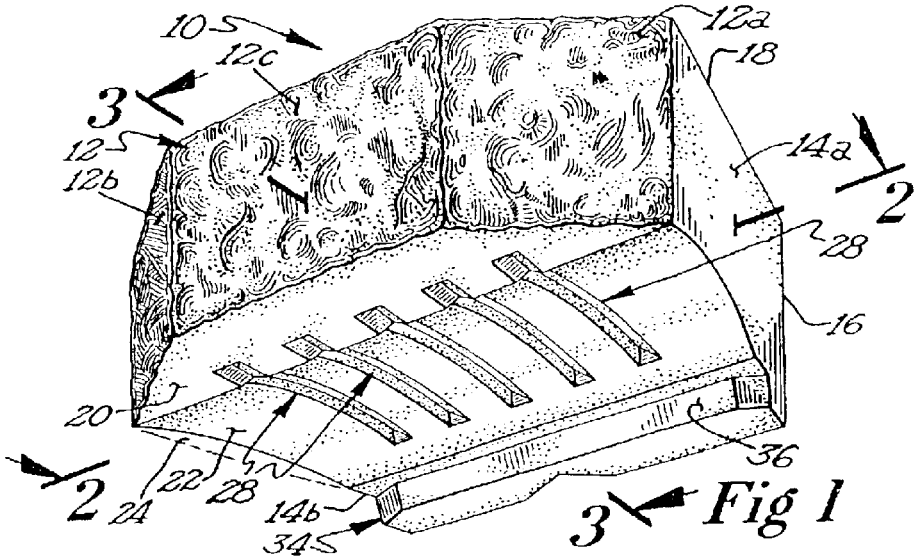
FIG. 1 is a perspective view of a block of the present invention, looking up at the bottom to reveal the details of the bottom surface.

These and other objectives and advantages of the invention will appear more fully from the following description, made in conjunction with the accompanying drawings wherein like reference characters refer to the same or similar parts throughout the several views. And, although the disclosure hereof is detailed and exact to enable those skilled in the art to practice the invention, the physical embodiments herein disclosed merely exemplify the invention, which may be embodied in other specific structures. While the preferred embodiment has been described, the details may be changed without departing from the invention, which is defined only by the claims.

Referring now to FIG. 1, there is shown a retaining wall block 10 having a front surface 12, side surfaces 14*a* and 14*b* extending rearwardly from front surface 12 and integral with rear surface 16. Top surface 18 is generally planar and continuous across its extents. Top surface 18 extends from side surface 14*a* to side surface 14*b* and from front surface 12 to rear surface 16. Preferably, top surface 18 is generally perpendicular to side surfaces 14*a* and 14*b*, and also to front surface 12 and rear surface 16.

In the preferred embodiment shown in the Figures, front surface 12 comprises three parts, 12*a*, 12*b*, and 12*c*. Part 12*c* is generally parallel to rear surface 16 and lies between parts 12*a* and 12*b*. Parts 12*a* and 12*b* are angled such that they extend from part 12*c* and diverge rearwardly to meet side surfaces 14*a* and 14*b*, respectively. Parts 12*a*, 12*b*, and 12*c* are shown as split faces as opposed to formed faces; creating a face with a rock splitter results in an irregular, more natural appearing surface. Also shown in the Figures is a rear surface 16, which has a smaller width than front surface 12 such that side surface 14*a* and 14*b* must converge rearwardly in order to be integral with rear surface 16. This shape allows the construction of straight, concave, convex, or serpentine walls without interrupting the relatively uniform appearance created by the front surfaces 12 of a plurality of blocks 10 forming a wall.

Figure 3:
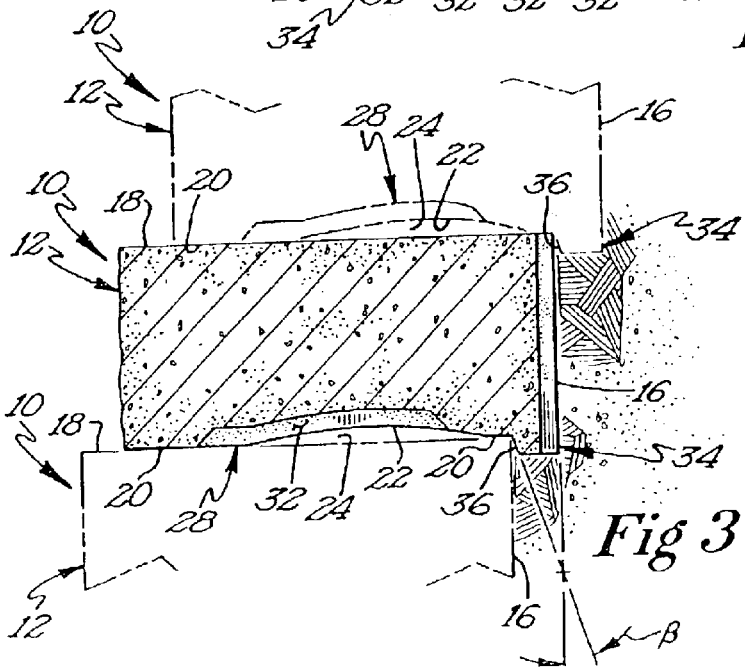
FIG. 3 is a cross sectional view of the block of the present invention taken along lines 3—3 of FIG. 1 and shown with other blocks in phantom, stacked, as in a retaining wall.
Figure 4:
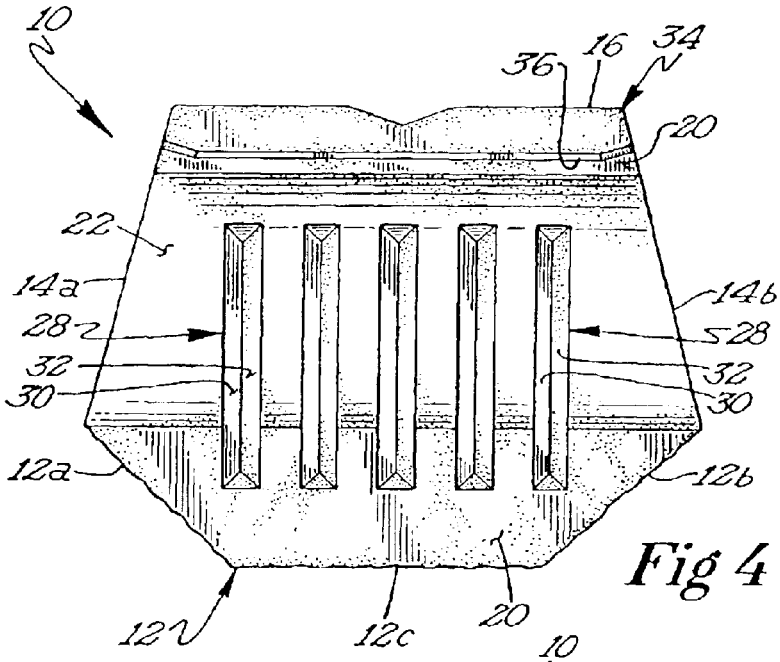
FIG. 4 is a bottom plan view of the block of FIG. 1.
Figure 5:
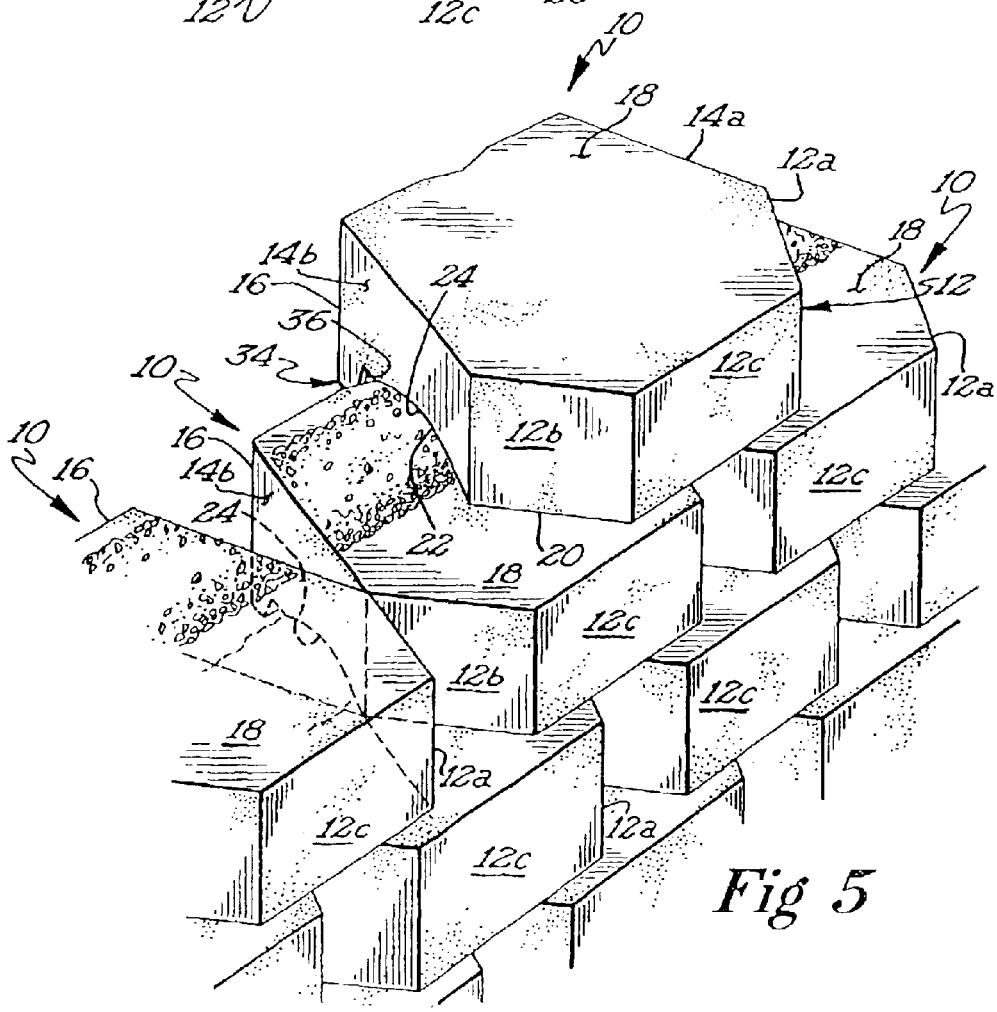
FIG. 5 is a perspective view of the block shown in FIG. 1 in a stacked relationship with other blocks, as in a wall, and showing debris resting on a lower course of blocks and accommodated for by the concave area of the bottom surface of the block of the present invention.

Bottom surface 20 extends from front surface 12 to rear surface 16 and from side surface 14*a* to side surface 14*b*. Bottom surface 20 includes concave or non-planar portion 22. Concave portion 22 is depicted in FIGS. 1, 3 and 4 as a relatively cylindrical indentation in bottom surface 20, extending from side surface 14*a* to side surface 14*b*. Preferably, portion 22 does not extend forward of where side surfaces 14*a* and 14*b* meet parts 12*a* and 12*b* of front surface 12. This way concave portion 22 is not visible in a completed wall, regardless of whether the wall is straight, concave, convex, or serpentine.

Allowing concave portion 22 to extend from side surface 14*a* to side surface 14*b* creates a gap 24 between the bottom surface 20 and the upper surface of a lower course of blocks when block 10 is placed thereon. This gap 24 may be used for ease in picking the block up and setting the block down. Also, as shown in FIGS. 1, 3 and 4, concave portion 22 extends rearwardly but ends forward of downward projection 34, which is described in more detail below. Ending the concave or, non-planar portion 22 forward of downward projection 34 provides another flat surface for block-to-block contact to assist in the leveling and stabilization of block 10 on a lower course of blocks.

Alternatively, it is envisioned that concave portion 22 be an indentation of any shape, such as the generally spherical shape of the embodiment shown in FIGS. 6–9. Preferably, portion 22 is large enough to occupy at least 30 percent, more preferably on the order of 50 to 75 percent, of the surface area of bottom surface 20.

Figure 2:
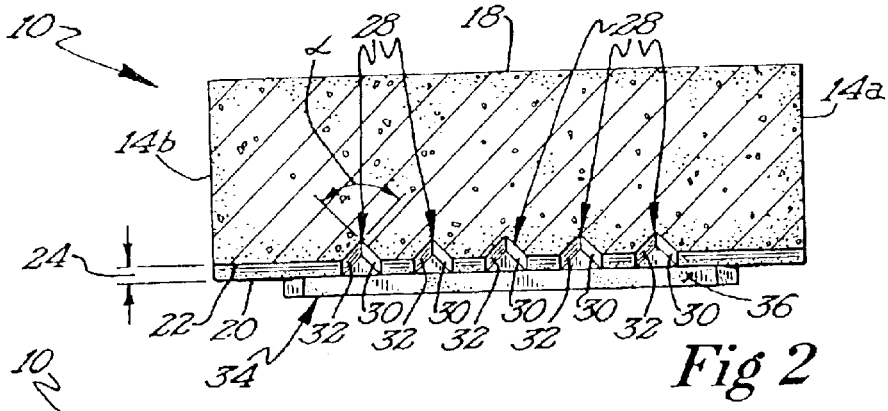
FIG. 2 is a cross sectional view of the block of the present invention taken along lines 2—2 of FIG. 1.

In a preferred embodiment, bottom surface 20 also includes at least one, preferably a plurality of, grooves 28. As shown in FIG. 2, grooves 28 are preferably "V"-shaped and extend from the bottom surface into the block toward top surface 18. In the embodiment depicted in FIGS. 1 and 2, grooves 28 are spaced generally equidistant from each other and oriented such that they extend from front to back generally across the non-planar portion 22. It is envisioned that grooves 28 could be located generally anywhere across bottom surface 20. It is preferred, however, that grooves 28 do not intersect front surface 12 so that grooves 28 remain hidden from view when block 10 is part of a completed wall.

Figure 7:
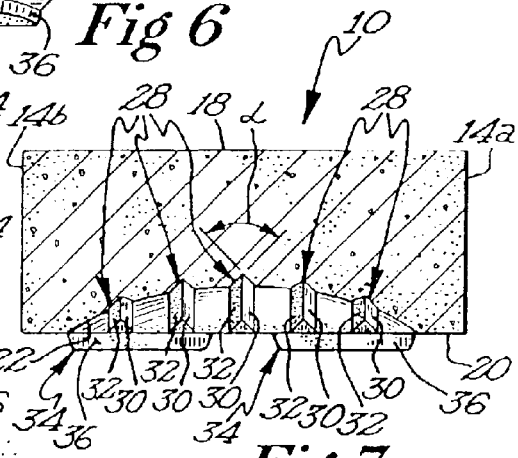
FIG. 7 is a sectional elevational view taken along lines 7—7 of FIG. 6.

Grooves 28 having the preferred "V" shape generally comprise at least a first surface 30 and a second surface 32. First surface 30 extends from bottom surface 20 and is integral with second surface 32. Second surface 32 extends from first surface 30 to bottom surface 20 thereby forming an angle α between first surface 30 and second surface 32 as seen in FIGS. 2 and 7. Angle α is preferably less than 180 degrees. Alternatively, first surface 30 and second surface 32 could be joined by a third surface (not shown in the Figures) which extends along the length of the groove and is juxtapose between the first and second surfaces. This third surface could be curved, thereby forming a "U" shaped groove, or the third surface could be flat, thereby forming a rectangular groove. However, a "V" shaped groove generally eases manufacturing.

Figure 6:
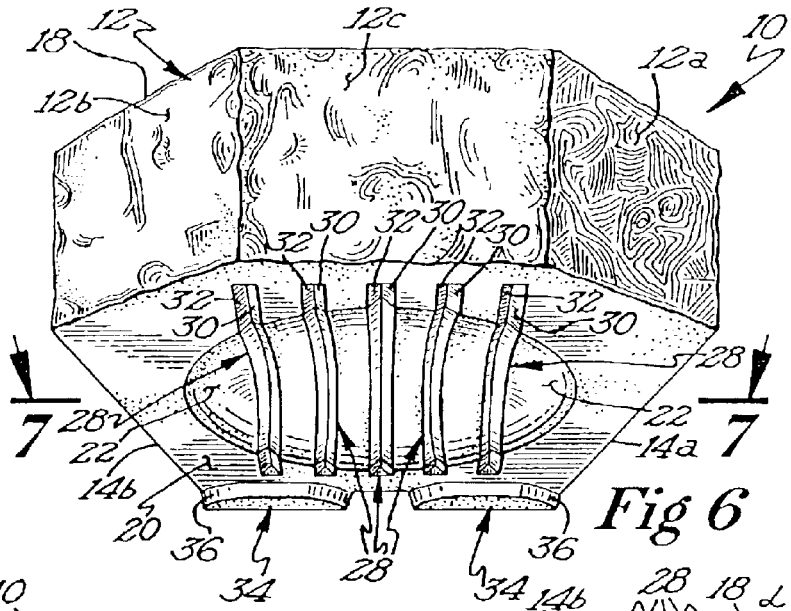
FIG. 6 is a perspective view of an alternative embodiment of the present invention, looking up at the bottom to show the detail of the bottom surface.
Figure 8:
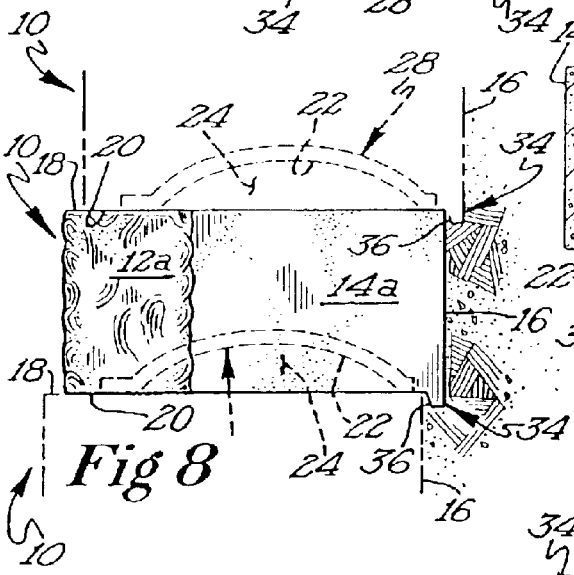
FIG. 8 is an end elevational view of a block of the embodiment shown in FIG. 6, in stacked relation, as in a wall, with other blocks shown in phantom; and, FIG. 9 is a bottom plan view of a block of the embodiment shown in FIG. 6.
Figure 9:
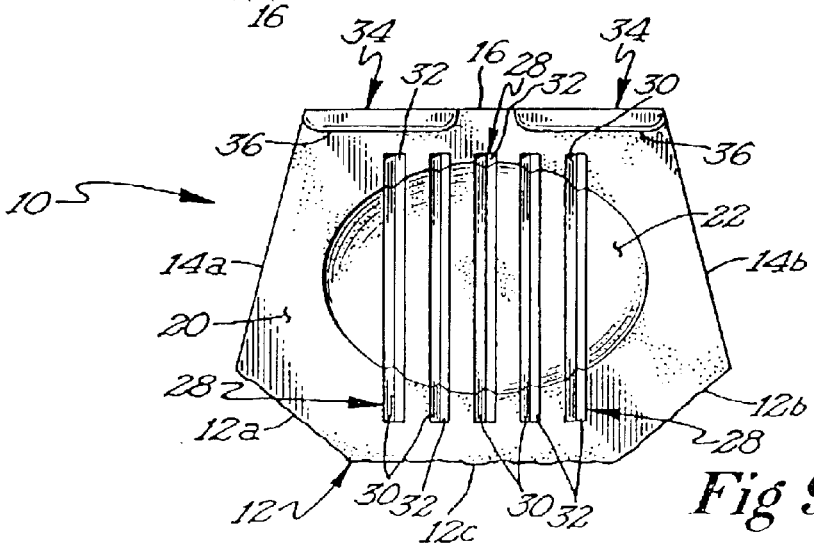

As shown in all Figures, bottom surface 20 also includes at least one downward projection 34. Downward projection 34 may extend across bottom surface 20, adjacent rear surface 16 as shown in FIGS. 1, 2, and 4. Alternatively, projection 34 may be broken into more than one projection 34 as shown in FIGS. 6, 7 and 9. Projection 34 has an abutting surface 36, which is used to abut against the rear surface 16 of a lower course of blocks, thereby forming a setback between successive courses of blocks. This setback adds strength and stability to the resulting wall.

Abutting surface 36 may be substantially parallel to rear surface 16. Alternatively, for ease of manufacture, abutting surface 36 may angle rearwardly forming a relatively small angle β with rear surface 16 as shown in FIG. 3. Angle β is preferably less than 45 degrees, more preferably less than 30 degrees. A smaller angle β provides more resistance to horizontal block slippage due to external forces against the back of the resulting wall.

The foregoing is considered as illustrative only of the principles of the invention. Furthermore, since numerous modifications and changes will readily occur to those skilled in the art, it is not desired to limit the invention to the exact construction and operation shown and described. While the preferred embodiment has been described, the details may be changed without departing from the invention, which is defined by the claims.

What is claimed is:

1. A block for use in constructing a multiple course retaining wall, the block comprising:

a substantially planar top surface;

a bottom surface;

opposing side surfaces, with each opposing side surface extending from the top surface to the bottom surface;

a front surface extending from the top surface to the bottom surface and extending between the opposing side surfaces, the front surface having an upper edge, a lower edge, and side edges, with the upper and lower edges being substantially parallel as viewed in front elevation, and with the side edges being substantially parallel as viewed in front elevation;

a back surface extending from the top surface to the bottom surface and extending between the opposing side surfaces;

wherein at least one of the opposing side surfaces is configured to intersect the back surface at an oblique angle; and, wherein the bottom surface has an upwardly recessed portion intersecting with and extending from one of the opposing side surfaces towards the other opposing side surface, with the upwardly recessed portion creating a gap between the bottom surface of the block and a top surface of a lower course of blocks when said block is placed on the lower course of blocks in construction of the retaining wall.

2. The block of claim 1 wherein the upwardly recessed portion accounts for greater than one-half of the total surface area of the bottom surface.

3. The block of claim 1 wherein said upwardly recessed portion is shaped to substantially form a portion of a cylinder.

4. The block of claim 1 wherein said upwardly recessed portion intersects both of said opposing side surfaces.

5. The block of claim 1 further comprising at least one elongate groove formed in the upwardly recessed portion of the bottom surface, wherein the elongate grove effectively increases the height of the gap formed by the upwardly recessed portion.

6. The block of claim 5 wherein the groove further comprises:

a first surface and a second surface;

the first surface extending along the length of said groove and connecting said bottom surface with the second surface;

the second surface extending along the length of said groove and connecting said bottom surface with the first surface and forming an angle ∀ (alpha) between the first surface and the second surface, said angle a having value of less than 180 degrees.

7. The block of claim 6 wherein said angle has a value between 120 degrees and 60 degrees.

8. The block of claim 1, further comprising a downwardly extending projection, with the projection arranged and configured to engage the back surface of a block in an adjacent lower course of blocks when said block is positioned on said adjacent lower course of blocks.

9. The block of claim 1, further comprising a downwardly extending projection, with the projection configured and arranged to engage a block in an adjacent lower course of blocks, the projection configured and arranged to position said block so that is offset with respect to said adjacent lower course of blocks.

10. The block of claim 1, wherein the front surface comprises a plurality of generally planar parts.

11. The block of claim 10, wherein one of the generally planar parts of the front surface is substantially parallel to the back surface of the block.

12. The block of claim 10, wherein at least two of the generally planar parts of the front surface are angled with respect to each other.

13. The block of claim 1, wherein the bottom surface further comprises a groove, with a substantial portion of the groove extending along the upwardly recessed portion of the bottom surface, wherein the groove effectively increases the height of the gap formed by the upwardly recessed portion.

14. The block of claim 1, wherein the upwardly recessed portion makes up more than one-quarter of the bottom surface.

15. The block of claim 1, wherein the top surface is configured and arranged to support a block positioned thereabove in a laterally non-interlocking relation.

16. The block of claim 1, wherein the rear surface is configured to contact and retain backfill material therebehind when said block is placed on a lower course of blocks in the construction of a retaining wall.

17. The block of claim 1, wherein the bottom surface further comprises a groove extending from a point in proximity to the intersection of the front and bottom surfaces to a point in proximity to the intersection of the rear and bottom surfaces.

18. The block of claim 1, wherein the upward recessed portion defines a peripheral area of contact for the bottom surface of the block as it is disposed upon the top surface of a block in a lower course of blocks, wherein the peripheral area of contact excludes the areas adjacent the intersection of the upwardly recessed portion and the opposing side walls.

19. The block of claim 1, wherein the upward recessed portion defines a peripheral area of contact for the bottom surface of the block as it is disposed upon the top surface of a block in a lower course of blocks, wherein the peripheral area of contact comprises two spaced-apart portions.

20. The block of claim 1, wherein the block is substantially free of vertical drain passages.

* * * * *

UNITED STATES PATENT AND TRADEMARK OFFICE

CERTIFICATE OF CORRECTION

PATENT NO. : 6,910,833 B2
APPLICATION NO. : 10/438385
DATED : June 28, 2005
INVENTOR(S) : Gerald P. Price and Raymond R. Price It is certified that error appears in the above-identified patent and that said Letters Patent is hereby corrected as shown below:

On the title page Related U.S. Application Data (63) -
Following "6,592,301" add ", which is a Continuation of Application No. 09/377,094, filed Aug. 19, 1999, now Pat. No. 6,250,850"

Signed and Sealed this

Twenty-fifth Day of July, 2006

JON W. DUDAS
*Director of the United States Patent and Trademark Office*